United States Patent [19]

Wilson et al.

[11] 4,224,058

[45] Sep. 23, 1980

[54] METHODS OF DESULPHURIZING FLUID MATERIALS

[75] Inventors: William G. Wilson, Pittsburgh, Pa.; D. Alan R. Kay, Hamilton, Canada

[73] Assignee: Molycorp, Inc., Brea, Calif.

[21] Appl. No.: 31,531

[22] Filed: Apr. 19, 1979

Related U.S. Application Data

[60] Division of Ser. No. 838,945, Oct. 3, 1977, Pat. No. 4,161,400, which is a continuation-in-part of Ser. No. 705,525, Jul. 15, 1976, Pat. No. 4,084,960.

[51] Int. Cl.[2] ..... C21C 7/02

[52] U.S. Cl. ..... 75/58; 75/53; 75/134 S; 423/47

[58] Field of Search ..... 75/53, 58, 134 S; 423/47

[56] References Cited

U.S. PATENT DOCUMENTS

| | | | |
|---|---|---|---|
| 3,211,549 | 10/1965 | Kusaka | 75/134 S |
| 3,784,374 | 1/1974 | Almand | 75/58 |
| 3,795,505 | 3/1974 | Corradini | 75/58 |
| 3,816,103 | 6/1974 | Link | 75/58 |
| 4,018,597 | 4/1977 | Staggers | 75/58 |

*Primary Examiner*—P. D. Rosenberg

*Attorney, Agent, or Firm*—Buell, Blenko & Ziesenheim

[57] ABSTRACT

A method for desulphurizing fluid materials such as molten iron, steel, stack gases, synthetic natural gases, boiler gases, coal gasification and liquification products and the like is provided in which one of the group rare earth oxides, rare earth fluocarbonates, rare earth oxyfluorides and mixtures thereof, including bastnasite concentrates are reacted at low oxygen potential, with the sulphur to be removed to form one of the group consisting of rare earth sulphides, rare earth oxysulphides and mixtures thereof. The low oxygen potential can be achieved by carrying out the reaction in the presence of vacuum, reducing gases, carbon, etc.

7 Claims, 6 Drawing Figures

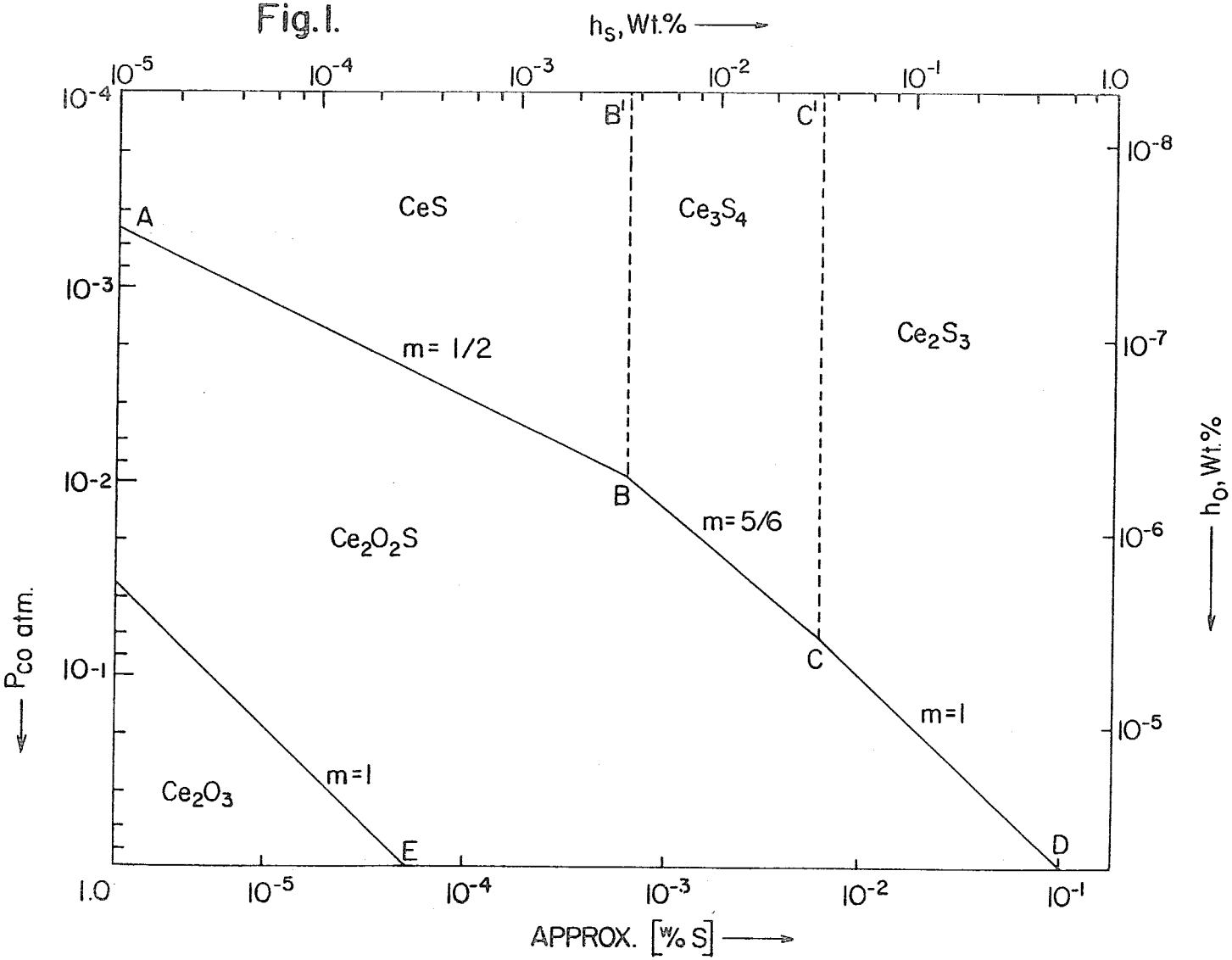
Fig. I.
$h_S$, Wt.%
$h_O$, Wt.%
$P_{CO}$ atm.
APPROX. [% S]
$10^{-5}$
$10^{-4}$
$10^{-3}$
$10^{-2}$
$10^{-1}$
1.0
$10^{-8}$
$10^{-7}$
$10^{-6}$
$10^{-5}$
A
B'
C'
B
C
D
E
CeS
$Ce_3S_4$
$Ce_2S_3$
$Ce_2O_2S$
$Ce_2O_3$
m= 1/2
m= 5/6
m=1
m=1

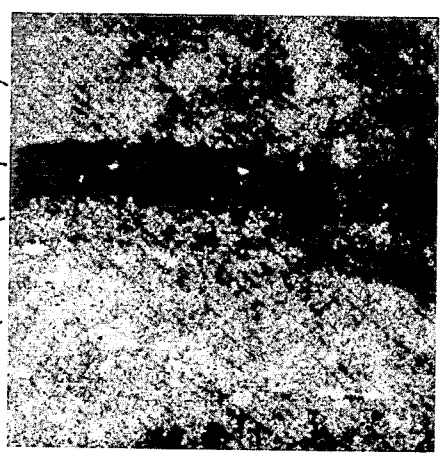
Fig. 2b Optical micrograph 200X.
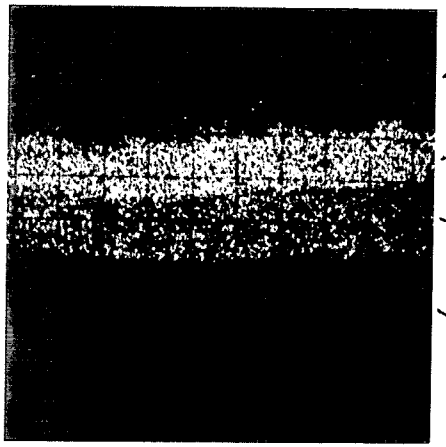
Fig. 2a X-ray sulphur microprobe image.

METHODS OF DESULPHURIZING FLUID MATERIALS

This application is a division of our copending application Ser. No. 838,945, filed Oct. 3, 1977 and allowed Jan. 5, 1979, U.S. Pat. No. 4,161,400, which in turn was a continuation-in-part of our then copending application Ser. No. 705,525, filed July 15, 1976, now U.S. Pat. No. 4,084,960, issued Apr. 18, 1978.

This invention relates to methods of desulphurizing fluid materials and particularly to a method of external desulphurizing fluids such as molten iron and steel, stack gases, coal gases, coal liquification products, and the like using rare earth oxides, rare earth fluorocarbonates or rare earth oxyfluorides in an essentially dry process.

As we have indicated above this method is adapted to the desulphurization of essentially any fluid material. We shall, however, discuss the method in connection with the two most pressing problems of desulphurization which industry presently faces, i.e. the desulphurization of molten iron and steel baths and the desulphurization of stack gases.

External desulphurization of molten iron and steel has been practiced for quite some time. It is a recognized, even necessary practice, in much of the iron and steel produced today. In current practices for desulphurization of iron and steel it is common to add magnesium metal, magcoke, calcium oxide, calcium carbide or mixtures of calcium oxide and calcium carbide as the desulphurizing agent. Unfortunately, there are serious problems, as well as major cost items involved, in the use of all of these materials for desulphurization. Obviously, both CaO and $CaC_2$ must be stored under dry conditions, since CaO will hydrate and $CaC_2$ will liberate acetylene on contact with moisture. Magnesium is, of course, highly incendiary and must be carefully stored and handled. There are also further problems associated with the disposal of spent desulphurization slags containing unreacted $CaC_2$.

We have found that these storage, material handling and disposal problems are markedly reduced by using rare earth oxides in a low oxygen content bath of molten iron or steel. The process is adapted to the desulphurization of pig iron or steel where carbon monoxide, evolved by the reaction, where carbon is used as a deoxidizer, is diluted with an inert gas such as nitrogen or by vacuum degassing the melt in order to reduce the oxygen potential and thereby increase the efficiency of the reaction by reducing the likelihood of forming oxysulfides. The principle may also be used for desulphurizing stack gases from boilers, etc., as we shall discuss in more detail hereafter.

In desulphurizing molten iron and steel in the practice of this invention we preferably follow the steps of reacting rare earth oxide, rare earth oxyfluorides, rare earth fluocarbonates and mixtures thereof including bastnasite concentrates in the presence of a deoxidizing agent with the sulphur to be removed to form one of the group consisting of are earth sulphide and are earth oxysulphide and mixtures thereof.

Preferably, hot metal is treated in a ladle or transfer car with rare earth oxides, by the simple addition and mixing of the rare earth oxides, by an injection technique in which the rare earth oxides are injected into the molten bath in a carrier gas such as argon or nitrogen or by the use of an "active lining" i.e., a rare earth oxide lining in the vessel. In any case, the chemical reactions involved are:

$$2CeO_2(s)+[C]=Ce_2O_3(s)+CO_{(g)} \quad (1)$$

$$RE_2O_3(s)+[C]+[S]_{1w/o}=RE_2O_2S_{(s)}+CO_{(g)} \quad (2) \text{ and}$$

$$RE_2O_2S_{(s)}+2[C]+2[S]_{1w/o}=RE_2S_{3(s)}+2CO_{(g)} \quad (3)$$

The product sulphide or oxysulphide will either be fixed in an 'active' lining or removed by flotation and absorbed into the slag cover and vessel lining depending upon the process used for introducing the rare earth oxide.

The products of desulphurization of carbon saturated iron with RE oxides is dependent on the partial pressure of CO, pCO, and the Henrian sulphur activity in the metal, $h_S$. Using cerium as the representative rare earth, the following standard free energy changes the equilibrium constants at 1500° C. for different desulphurization reactions can be calculated from thermodynamic data in the literature:

| REACTION | ΔG° cal. | $K_{1773}$ |
|---|---|---|
| $2CeO_{2(s)} + [C] = Ce_2O_{3(s)} + CO_{(g)}$ | 66000 − 53.16T | $pCO = 3041$ |
| $Ce_2O_{3(s)} + [C] + [S]_{1w/o} = Ce_2O_2S_{(s)} + CO_{(g)}$ | 18220 − 26.43T | $pCO/h_S = 3395$ |
| $Ce_2O_2S_{(s)} + 2[C] + 2[S]_{1w/o} = Ce_2S_{3(s)} + 2CO_{(g)}$ | 66180 − 39.86T | $p^2CO/h_S^2 = 3.6$ |
| $3/2\ Ce_2O_2S_{(s)} + 3[C] + 5/2[S]_{1w/o} = Ce_3S_{4(s)} + 3CO_{(g)}$ | 127050 − 72.1T | $p^3CO/h_S^{5/2} = 1.25$ |
| $Ce_2O_2S_{(s)} + 2[C] + [S]_{1w/o} = 2CeS_{(s)} + 2CO_{(g)}$ | 120,860 − 61.0T | $p^2CO/h_S = .027$ |
| $C_{(s)} + \frac{1}{2} O_{2(g)} = CO_{(g)}$ | −28200 − 20.16T | $pCO/p^{\frac{1}{2}}O_2 = 7.6 \times 10^{-7}$ |
| $\frac{1}{2}S_{2(g)} = [S]_{1w/o}$ | −31520 + 5.27T | $h_S/p^{\frac{1}{2}}S_2 = 5.4 \times 10^2$ |

The thermodynamics of desulphurization with lanthanium oxide, $La_2O_3$, are similar although, in this case, $LaO_2$ is unstable and there will be no conversion corresponding to $CeO_2 \rightarrow Ce_2O_3$.

In the case of desulphurization of gases, such as stack gases, assuming the following gas composition at 1000° C.:

| Component | Vol.% |
|---|---|
| $CO_2$ | 16 |
| CO | 40 |
| $H_2$ | 40 |
| $N_2$ | 4 |
| $H_2S$ | 0.3 |
| | (200 grains/100 ft$^3$.) |

This equilibrium gas composition is reversed by point A on the diagram illustrated as FIG. 6 where $CO/CO_2=2.5$ and $H_2/H_2S=133$. This point lies within the $Ce_2O_2S$ phase field and at constant $CO/CO_2$ desulphurization with $Ce_2O_3$ will take place up to point B. At point B, $H_2/H_2S \simeq 10^4$ and the concentration of $H_2S$ is 0.004 vol.% (~3 grains/100 ft.$^3$). Beyond this point, desulphurization is not possible.

The basic theory for this invention is supported by the standard free energies of rare earth compounds likely to be involved. Examples of these appear in Table I which follows:

TABLE 1

Standard Free Energies of Formation of Some Rare Earth Compounds: $\Delta G^\circ = X - YT$ cal/g.f.w.

| Reaction | X | Y | Temp.(°K.) | Estimated Error (kcal) |
|---|---|---|---|---|
| $CeO_{2(s)} = Ce_{(1)} + O_{2(g)}$ | 259,900 | 49.5 | 1071–2000 | ±3 |
| $Ce_2O_{3(s)} = 2Ce_{(1)} + 3/2\ O_{2(g)}$ | 425,621 | 66.0 | 1071–2000 | ±3 |
| $La_2O_{3(s)} = 2La_{(1)} + 3/2\ O_{2(g)}$ | 428,655 | 68.0 | 1193–2000 | ±3 |
| $CeS_{(s)} = Ce_{(1)} + \frac{1}{2}\ S_{2(g)}$ | 132,480 | 24.9 | 1071–2000 | ±2 |
| $Ce_3S_{4(s)} = 3Ce_{(1)} + 2S_{2(g)}$ | 483,180 | 98.2* | 1071–2000 | ±10 |
| $Ce_2S_{3(s)} = 2Ce_{(1)} + 3/2\ S_{2(g)}$ | 351,160* | 76.0* | 1071–2000 | ±10 |
| $LaS_{(s)} = La_{(1)} + \frac{1}{2}\ S_{2(g)}$ | 123,250 | 25.3 | 1193–2000 | ±6 |
| $Ce_2O_2S_{(s)} = 2Ce_{(1)} + O_{2(g)}\ O_{2(g)} + \frac{1}{2}\ S_{2(g)}$ | 410,730 | 65.0 | 1071–2000 | ±15 |
| $La_2O_2S_{(s)} = 2La_{(s)} + O_{2(g)} + \frac{1}{2}\ S_{2(g)}$ | 407,700* | 65.0* | 1193–2000 | ±15 |

*Estimated

The three phase equilibria at 1273° K. for the Ce—O—S System is set out in Table II as follows:

TABLE II

Ce-O-S System
Three Phase Equilibria at 1273° K.

| REACTION | $\Delta G^\circ$ cal | $K_{1273}$ |
|---|---|---|
| $Ce_2O_{3(s)} + \frac{1}{2}S_{2(g)} = Ce_2O_2S_{(s)} + \frac{1}{2}O_{2(g)}$ | 14890 − 1.0T | $(pO_2/pS_2)^{\frac{1}{2}} = 4.6 \times 10^{-3}$ |
| $Ce_2O_2S_{(s)} + \frac{1}{2}S_{2(g)} = 2CeS_{(s)} + O_{2(g)}$ | 145770 − 15.2T | $pO_2/p^{\frac{1}{2}}S_2 = 2.0 \times 10^{-22}$ |
| $3Ce_2O_2S_{(s)} + 5/2\ S_{2(g)} = 2Ce_3S_{4(s)} + 3O_{2(g)}$ | 265830 + 1.4T | $p^3O_2/p^{5/2}S_2 = 1.1 \times 10^{-46}$ |
| $Ce_2O_2S_{(s)} + S_{2(g)} = Ce_2S_3 + O_{2(g)}$ | 59570 + 11.0T | $pO_2/pS_2 = 2.3 \times 10^{-13}$ |
| $Ce_3S_{4(s)} = 3CeS_{(s)} + \frac{1}{2}S_{2(g)}$ | 85740 − 23.5T | $p^{\frac{1}{2}}S_2 = 2.5 \times 10^{-10}$ |
| $2Ce_2S_{3(s)} = 2Ce_3S_{4(s)} + \frac{1}{2}S_{2(g)}$ | 87120 − 31.6T | $p^{\frac{1}{2}}S_2 = 8.9 \times 10^{-8}$ |
| $CO_{(g)} + \frac{1}{2}O_{2(g)} = CO_{2(g)}$ | −67500 + 20.75T | $pCO_2/(pCO\ .\ p^{\frac{1}{2}}O_2) = 1.1 \times 10^7$ |
| $H_{2(g)} + \frac{1}{2}S_{2(g)} = H_2S_{(g)}$ | −21580 + 11.80T | $pH_2S/(pH_2\ .\ p^{\frac{1}{2}}S_2) = 13.4$ |
| $H_{2(g)} + \frac{1}{2}O_{2(g)} = H_2O_{(g)}$ | −58900 + 13.1T | $pH_2O/(pH_2\ .\ p^{\frac{1}{2}}O_2) = 1.8 \times 10^7$ |

Typical calculations of energy changes involved in the systems involved in this invention are as follows:

$S_{2(g)} + Ce_2O_2S_{(s)} = Ce_2S_{3(s)} + O_{2(g)}$ $Ce_2S_{3(s)} = 2Ce_{(l)} + 3/2\ S_{2(g)} : \Delta G^\circ = 351160 - 76.0T$ cal $Ce_2O_2S_{(s)} = 2Ce_{(l)} + O_{2(g)} + \frac{1}{2}\ S_{2(g)} : \Delta G^\circ = 410730 - 65.0T$ cal $Ce_2O_2S_{(s)} + S_{2(g)} = Ce_2S_{3(s)} + O_{2(g)} : \Delta G^\circ = 59570 + 11.0T$ cal @ 1273° K. $\Delta G^\circ = 73573$ cal and $pO_2/pS_2 = 2.33 \times 10^{-13}$ $Ce_2O_{3(s)} + \frac{1}{2}\ S_{2(g)} = Ce_2O_2S + \frac{1}{2}\ O_{2(g)}$ $Ce_2O_{3(s)} = 2Ce_{(l)} + 3/2O_{2(g)} : \Delta G^\circ = 425621 - 66.0T$ cal $Ce_2O_2S_{(s)} = 2Ce_{(l)} + O_{2(g)} + \frac{1}{2}\ S_{2(g)} : \Delta G^\circ = 410730 - 65.0T$ cal $Ce_2O_{3(s)} + \frac{1}{2}\ S_{2(g)} = Ce_2O_2S_{(s)} + \frac{1}{2}\ O_{2(g)}$:

$\Delta G^\circ$ 14891 − 1.0T cal

@ 1273° K. $\Delta G^\circ = 13618$ cal and $(pO_2/pS_2)^{\frac{1}{2}} = 4.6 \times 10^{-3}$ $Ce_2O_2S_{(s)} + \frac{1}{2}\ S_{2(g)} = 2CeS_{(s)} + O_{2(g)}$ $Ce_2O_2S_{(s)} = 2Ce_{(l)} + \frac{1}{2}\ S_{2(g)} + O_{2(g)} : \Delta G^\circ = 410730 - 65.0T$ cal $2CeS_{(s)} = 2Ce_{(l)} + S_{2(g)} : \Delta G^\circ = 264960 - 49.8T$ cal $Ce_2O_2S_{(s)} + \frac{1}{2}\ S_{2(g)} = 2CeS_{(s)} + O_{2(g)}$:

$\Delta G^\circ = 145770 - 15.2T$ cal

@ 1273° K. $\Delta G^\circ = 126420$ cal. and $pO_2/p^{\frac{1}{2}}S_2 = 1.96 \times 10^{-22}$ $3Ce_2O_2S_{(s)} + 5/2\ S_{2(g)} = 2Ce_3S_{4(s)} + 3\ O_{2(g)}$ $2Ce_3S_{4(s)} = 6Ce_{(l)} + 4S_{2(g)} : \Delta G^\circ = 966360 - 196.4T$ cal $3Ce_2O_2S_{(s)} = 6Ce_{(l)} + 3\ O_{2(g)} + 3/2\ S_{2(g)}$:

$\Delta G^\circ = 1232190 - 195.0T$ cal $3Ce_2O_2S_{(s)} + 5/2\ S_{2(g)} = 2Ce_3S_{4(s)} + 3\ O_{2(g)}$:

$\Delta G^\circ = 265830 + 1.4T$ cal

@ 1273° K. $\Delta G^\circ = 267612$ cal and $p^3O_2/p^{5/2}S_2 = 1.12 \times 10^{-46}$ $Ce_3S_{4(s)} = 3CeS_{(s)} + \frac{1}{2}\ S_{2(g)}$ $Ce_3S_{4(s)} = 3Ce_{(l)} + 2S_{3(g)} : \Delta G^\circ = 48318 - 98.2T$ cal.

$3CeS_{(s)} = 3Ce_{(l)} + 3/2\ S_{2(g)} : \Delta G^\circ = 397,440 - 74.7T$ cal.

$Ce_3S_{4(s)} = 3CeS_{(s)} + \frac{1}{2}\ S_{2(g)} : \Delta G^\circ = 85740 - 23.5T$ cal.

@ 1273° K. $\Delta G^\circ = 55824$ cal $p^{\frac{1}{2}}S_2 = 2.6 \times 10^{-10}$ -continued $3Ce_2S_{3(s)} = 2Ce_3S_{4(s)} + \frac{1}{2}\ S_{2(g)}$ $2Ce_3S_{4(s)} = 6Ce_{(l)} + 4\ S_{2(g)} : \Delta G^\circ = 966360 - 196.4T$ cal.

$3Ce_2S_{3(s)} = 6Ce_{(l)} + 9/2\ S_{2(g)} : \Delta G^\circ = 1053480 - 228.0T$ cal.

$3Ce_2S_{3(s)} = 2Ce_3S_{4(s)} + \frac{1}{2}\ S_{2(g)} : \Delta G^\circ = 87120 - 31.6T$ cal.

@ 1273° K. $\Delta G^\circ = 468893$ cal. and $p^{\frac{1}{2}}S_2 = 8.9 \times 10^{-9}$ $H_{2(g)} + \frac{1}{2}\ S_{2(g)} = H_2S_{(g)}$ $H_{2(g)} + \frac{1}{2}\ S_{2(g)} = H_2S_{(g)} : \Delta G^\circ = -21580 + 11.80T$ cal.

@ 1273° K. $\Delta G^\circ = -6559$ and $pH_2S/(pH_2\ .\ p^{\frac{1}{2}}S_2) = 13.4$

| $pH_2/pH_2S$ | log $pS_2$ |
|---|---|
| 1 | −2.25 |
| $10^2$ | −6.25 |
| $10^4$ | −10.25 |
| $10^6$ | −14.25 |
| $10^8$ | −18.25 |
| $10^{10}$ | −22.25 |
| $10^{12}$ | −26.25 |

$H_{2(g)} + \frac{1}{2}\ O_{2(g)} = H_2O_{(g)}$ $H_{2(g)} + \frac{1}{2}\ O_{2(g)} = H_2O_{(g)} : \Delta G^\circ = -58900 + 13.1T$ cal.

@ 1273° K. $\Delta G^\circ = -42223$ cal. and $(pH_2/pH_2O)$ $p^{\frac{1}{2}}O_2 = 5.6 \times 10^{-8}$

| $pH_2/pH_2O$ | log $pO_2$ |
|---|---|
| $10^{-4}$ | −6.5 |
| $10^{-2}$ | −10.5 |
| 1 | −14.5 |
| $10^2$ | −18.5 |
| $10^4$ | −22.5 |
| $10^6$ | −26.5 |
| $10^8$ | −30.5 |

$CO_{(g)} + \frac{1}{2}\ O_{2(g)} = CO_{2(g)}$ $CO_{(g)} + \frac{1}{2}\ O_{2(g)} = CO_{2(g)} : \Delta G^\circ = -67500 + 20.75T$ cal.

@ 1273° K. $\Delta G^\circ = -41085$ and $pCO_2/(pCO\ .\ p^{\frac{1}{2}}O_2) = 1.1 \times 10^7$

| $pCO/pCO_2$ | log $pO_2$ |
|---|---|
| $10^{-4}$ | −6.1 |
| $10^{-2}$ | −10.1 |
| 1 | −14.1 |
| $10^2$ | −18.1 |
| $10^4$ | −20.1 |
| $10^6$ | −24.1 |
| $10^8$ | −30.1 |

In the foregoing general description of this invention, certain objects, purposes and advantages have been outlined. Other objects, purposes and advantages of this invention will be apparent, however, from the following description and the accompanying drawings in which:

FIG. 1 is a stability diagram showing w/o sulphur as partial pressure of CO;

FIG. 2*a* and 2*b* show $Ce_2S_3$ and $Ce_2O_2S$ layers on a pellet of $CeO_2$;

Referring back to the discussion of free energy set out above, it is clear that these free energy changes may be used to determine the fields of stability of $Ce_2O_3$, $Ce_2O_2S$, $Ce_2S_3$, $Ce_3S_4$ and CeS in terms of the partial pressure of Co and the Henrian sulphur activity of the melt at 1500° C. The resultant stability diagram is shown in FIG. 1, the boundaries between the phase fields being given by the following relationships:

| BOUNDARY | EQUATION |
|---|---|
| $Ce_2O_3$—$Ce_2O_2S$ | $\log pCO = \log h_S + 3.53$ |
| $Ce_2O_2S$—$Ce_2S_3$ | $\log pCO = \log h_S + 0.28$ |
| $Ce_2O_2S$—$Ce_3S_4$ | $\log pCO = 0.83 \log h_S + 0.03$ |
| $Ce_2O_2S$—Ces | $\log pCO = 0.5 \log h_S - 0.79$ |
| $Ce_2S_3$—$Ce_3S_4$ | $\log h_S = -1.47$ |
| $Ce_3S_4$—CeS | $\log h_S = -2.45$ |

The phase fields in FIG. 1 are also shown in terms of the Henrian activity of oxygen, $h_O$, and the approximate [w/o S] in the iron melt using an activity coefficient $f_S \simeq 5.5$ for graphite saturated conditions.

The coordinates of the points B, C, D and E on the diagram are given below:

| COORDINATES | B | C | D | E |
|---|---|---|---|---|
| pCO atm. | $9.8 \times 10^{-3}$ | $6.5 \times 10^{-2}$ | 1.0 | 1.0 |
| $h_S$ | $3.5 \times 10^{-3}$ | $3.4 \times 10^{-2}$ | $5.3 \times 10^{-1}$ | $2.9 \times 10^{-4}$ |
| Approx. [w/o S] | $6.4 \times 10^{-4}$ | $6.2 \times 10^{-3}$ | $9.6 \times 10^{-2}$ | $5.3 \times 10^{-5}$ |

The points B and C represent simultaneous equilibria between the oxysulphide and two sulphides at 1500° C. These univariant points are only a function of temperature. The points E and D represent the minimum sulphur contents or activities at which oxysulphide and $Ce_2S_3$ can be formed, respectively, at pCO=1 atm. Thus, carbon saturated hot metal cannot be desulphurized by oxysulphide formation below $h_S \simeq 2.9 \times 10^{-4}$ ([w/o S]$\simeq 5.3 \times 10^{-5}$) at pCO=1 atm. However, lower sulphur levels may be attained by reducing the partial pressure of CO.

The conversion of $CeO_2 \rightarrow Ce_2O_3 \rightarrow Ce_2O_2S \rightarrow Ce_2S_3$ is illustrated in FIGS. 2*a* and 2*b* which show $Ce_2S_3$ and $Ce_2O_2S$ layers on a pellet of $CeO_2$ (which first transformed to $Ce_2O_3$) on immersion in graphite saturated iron at ~1600° C., initially containing 0.10 w/o S, for 10 hours. The final sulphur content was ~0.03 w/o S and the experiment was carried out under argon, where pCO<<1 atm.

The conversion of the oxide to oxysulphide and sulphide is mass transfer controlled and, as in conventional external desulphurization with $CaC_2$, vigorous stirring will be required for the simple addition process and circulation of hot metal may be required in the 'active' lining process.

Figure 3:
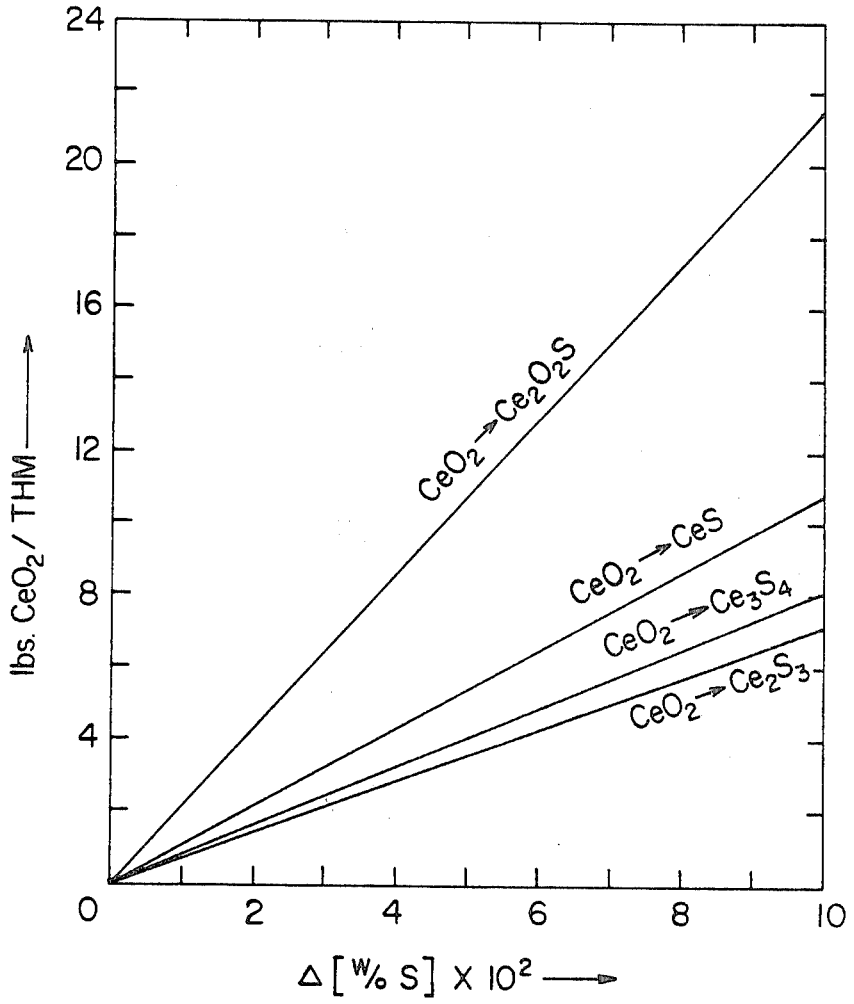
FIG. 3 is a graph of the theoretical $CeO_2$ required for removal of 0.01 w/o S/THM.

From FIG. 1 it is apparent that the external desulphurization of graphite saturated iron is thermodynamically possible using RE oxides. For example the diagram indicates that hot metal sulphur levels of ~0.5 ppm (point E) can be achieved by cerium oxide addition even at pCO=1 atm. Desulphurization in this case will take place through the transformation sequence $CeO_2 \rightarrow Ce_2O_3 \rightarrow Ce_2O_2S$ which required 2 moles of $CeO_2$ to remove 1 gm. atom of sulphur. The efficiency of sulphur removal/lb. $CeO_2$ added can, however, be greatly increased by the formation of sulphides. 1 mole $CeO_2$ is required per g. atom of sulphur for CeS formation and $\frac{2}{3}$ moles $CeO_2$ for $Ce_2S_3$ formation. The theoretical $CeO_2$ requirements for the removal of 0.01 w/o S/THM for the various desulphurization products are given below and expressed graphically in FIG. 3.

| PRODUCT | lb $CeO_2$/0.01 w/o S.THM | $ft^3$CO/lb $CeO_2$ | $ft^3$CO/0.01 w/o S.THM |
|---|---|---|---|
| $Ce_2O_2S$ | 2.15 | 2.1 | 4.5 |
| CeS | 1.1 | 4.2 | 4.5 |
| $Ce_3S_4$ | 0.8 | 4.2 | 3.4 |
| $Ce_2S_3$ | 0.7 | 4.2 | 3.0 |

The volume of carbon monoxide produced in $ft^3$CO/lb $CeO_2$ and $ft^3$CO/0.01 w/o S.THM are also given in the above table for each desulphurization product. For efficient desulphurization the partial pressure of carbon monoxide should be sufficiently low to avoid oxysulphide formation. For example, FIG. 1 shows that oxysulphide will not form in a graphite saturated melt until [w/o S]<0.01 when pCO≃0.1 atm. It will form however when [w/o S]≃0.10 at pCO=1 atm. Thus by reducing the pCO in the desulphurization process to 0.1 atm., hot metal can be desulphurized to 0.01 w/o S with a $CeO_2$ addition of 0.72 lb/0.01 w/o S removed for each ton hot metal.

The choice of the method of reducing the partial pressure of carbon monoxide depends on economic and technical considerations. However, in an injection process calculations can be made for the volume of injection gas, say nitrogen, required to produce a given pCO. Thus:

$$V_{N2} = V_{CO}(1\text{-}pCO)/pCO$$

where $V_{CO}$ is the scf of CO formed/lb $CeO_2$ added $V_{N2}$ is the scf of $N_2$ required/lb $CeO_2$ added and pCO is the desired partial pressure of CO in atm.

Figure 4:
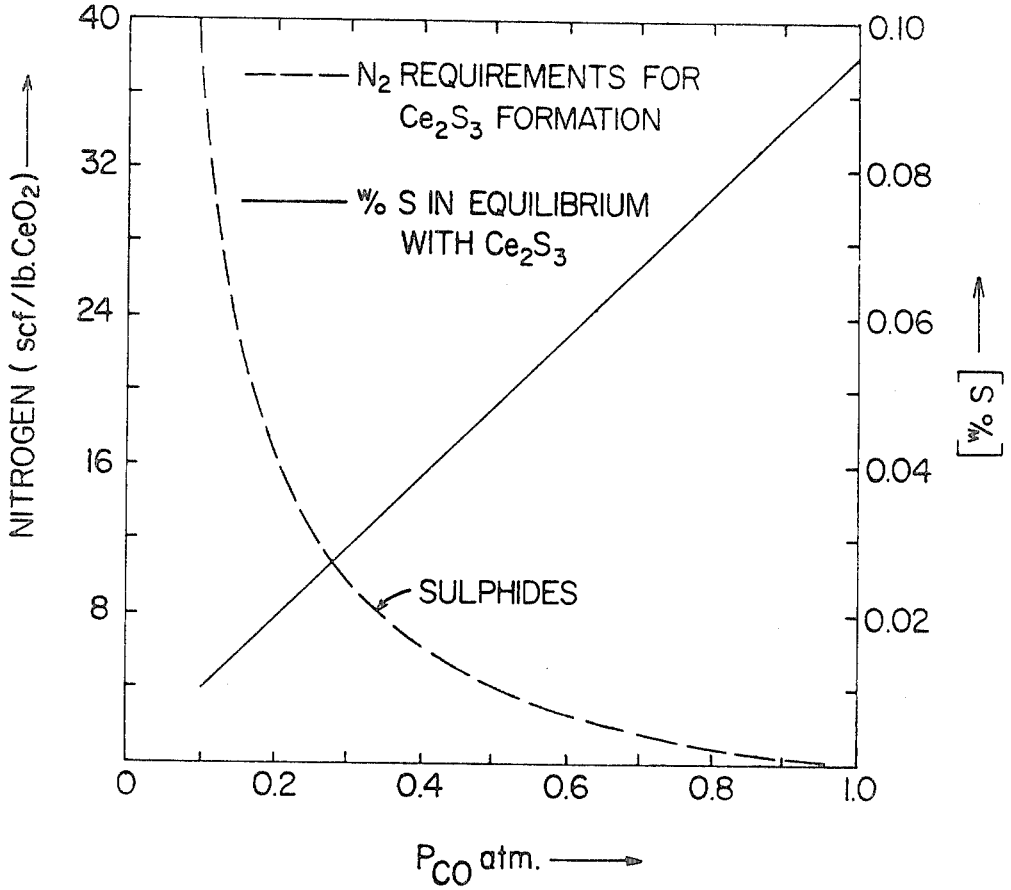
FIG. 4 is a graph showing the volume of nitrogen required to produce a given partial pressure of CO.

The results of these calculations for $Ce_2S_3$ formation are shown in FIG. 4, which also shows the [w/o S] in equilibrium with $Ce_2S_{3(s)}$ as a function of pCO. From this figure it is apparent that the volume of $N_2$/lb $CeO_2$ required to form $Ce_2S_3$ is excessive and if an injection process were used a balance would have to be struck between sulphide and oxysulphide formation. When, for example, hot metal is to desulphurize from 0.05 to 0.01 w/o S at pCO=0.2 atm., 1[16 scf $N_2$/lb $CeO_2$ would be required for $Ce_2S_3$ formation and the sulphur content would drop to 0.02 w/o. The remaining 0.01 w/o S would be removed by oxysulphide formation. From FIG. 3, it can be seen that ~2 lbs of $CeO_2$/THM would be required for $Ce_2S_3$ formation and 2 lbs for $Ce_2O_2S$ formation giving a total requirement of 4 lbs $CeO_2$/THM.

Figure 5:
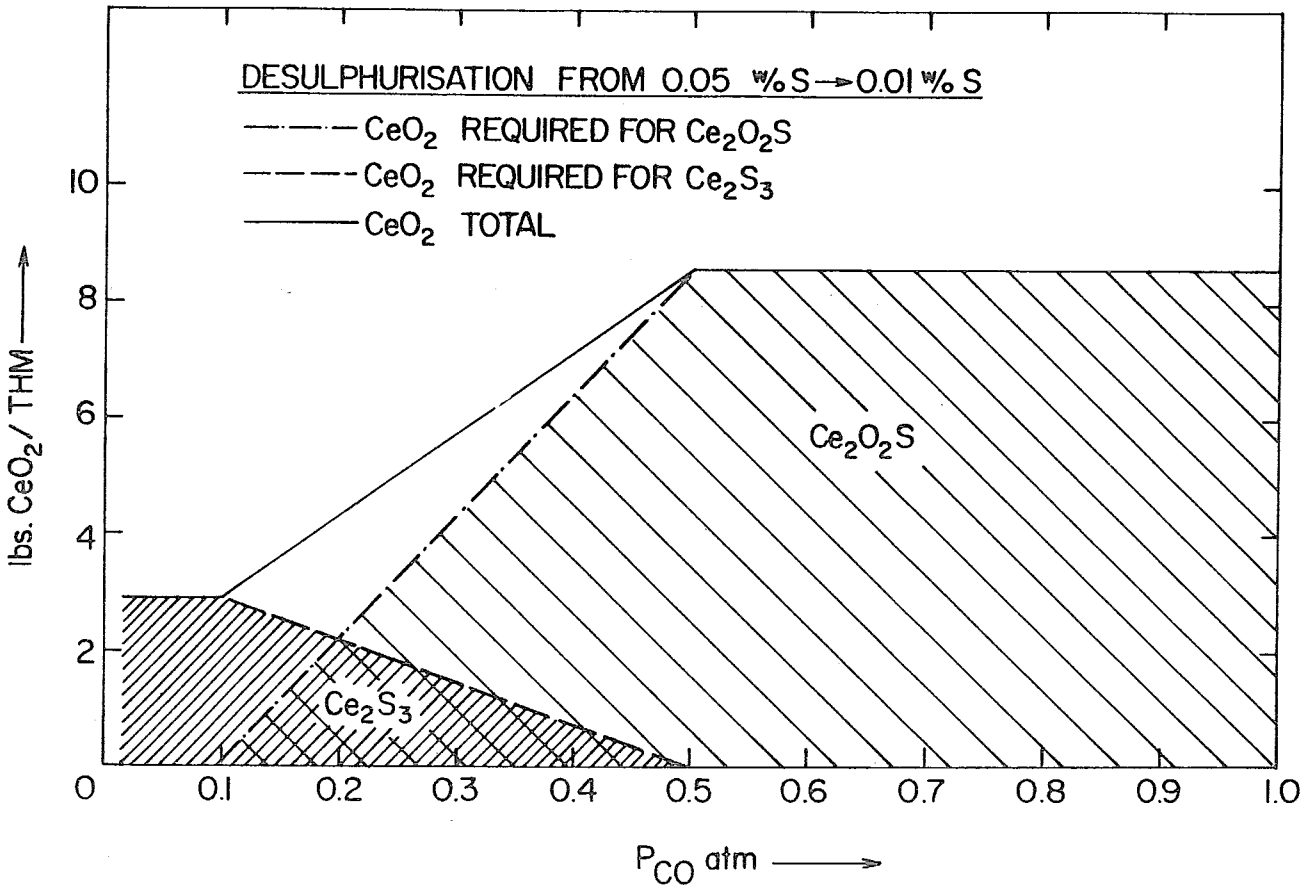
FIG. 5 is a graph showing the $CeO_2$ requirements as a function of partial pressure of CO.
Figure 6:
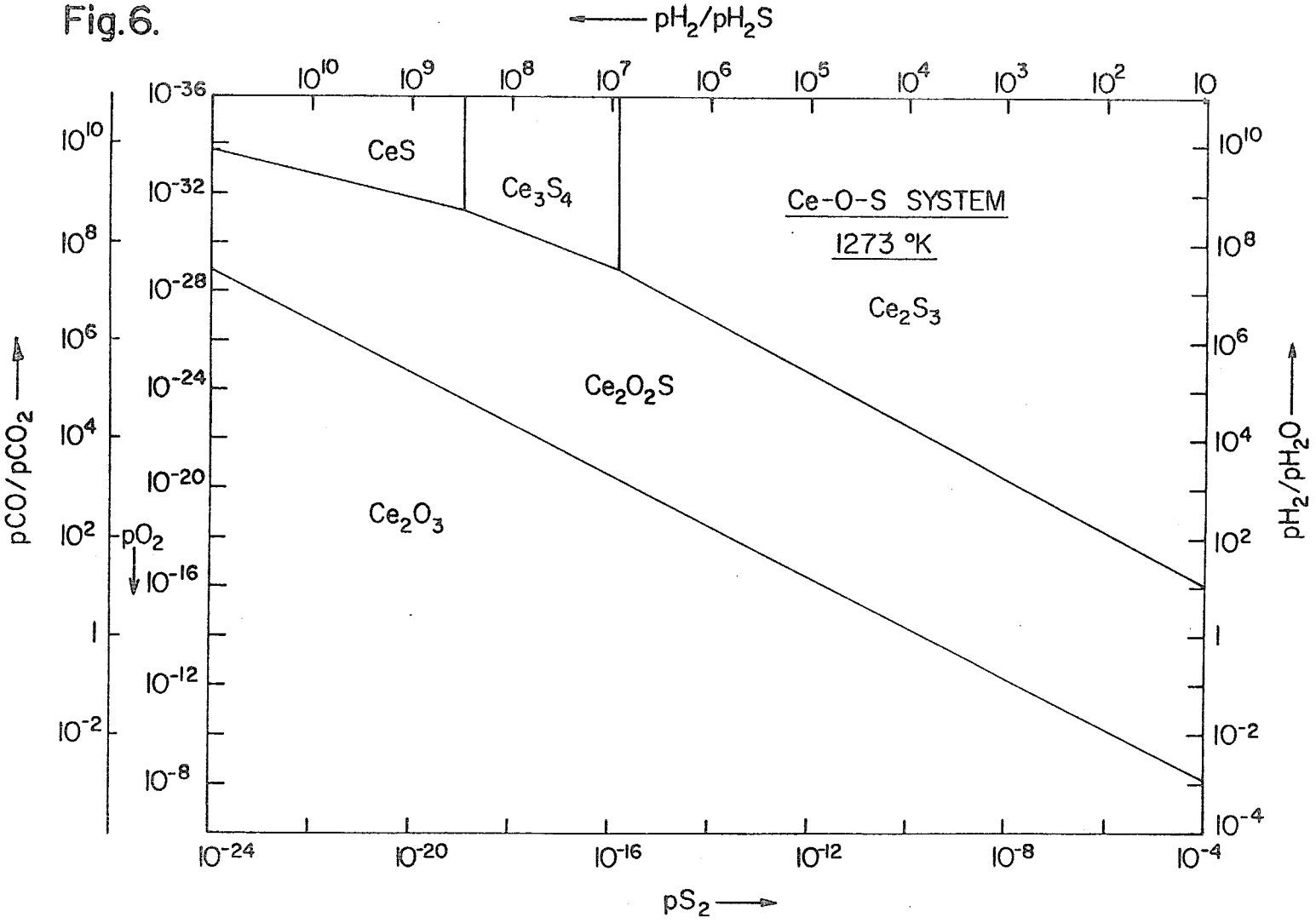
FIG. 6 is a stability diagram for stack gas systems treated according to this invention.

Calculations similar to the one above have been used to construct FIG. 5 where the $CeO_2$ requirements in lbs/THM are shown as a function of pCO.

When large volumes of nitrogen are used in an injection process the heat carried away by the nitrogen, as sensible heat, is not large but the increased losses by radiation may be excessive. Injection rates with $CaC_2$ for example are in the order of 0.1 scf $N_2$/lb $CaC_2$.

Vacuum processing is an alternative method of reducing the partial pressure of carbon monoxide. This is impractical in hot metal external desulphurization but not in steelmaking (see below).

Still another alternative approach to external desulphurization using rare earth oxides is the use of active linings which would involve the 'gunning' or flame-spraying of HM transfer car linings with rare earth oxides. Here the oxides would transform to oxysulphides during the transfer of hot metal from the blast furnace to the steelmaking plant, and the oxide would be regenerated by atmospheric oxidation when the car was emptied. It is estimated that for a 200 ton transfer car, conversion of a 2 mm layer (~0.080") of oxide to oxysulphide would reduce the sulphur content of the hot metal by ~0.02 w/o S. This process has the following advantages:

(1) continuous regeneration of rare earth oxide by atmospheric oxidation when the car is empty,
(2) reaction times would be in the order of hours,
(3) the absence of a sulphur rich desulphurization slag, and
(4) the absence of suspended sulphides in the hot metal.

The mechanical integrity and the life of an "active" lining is, of course, critical and some pollution problems may be associated with oxide regeneration by atmospheric oxidation.

With regard to steelmaking applications, vacuum desulphurization could be carried out by an "active" lining in the ASEA-SKF process and circulation vacuum degassing processes.

In the foregoing specification, we have set out certain preferred practices and embodiments of our invention, however, it will be understood that this invention may be otherwise embodied within the scope of the following claims.

We claim:

1. A method of desulphurizing fluid materials comprising the steps of reacting a member from the group consisting of rare earth oxides, rare earth fluocarbonates and rare earth oxyfluorides with sulphur to be removed from the fluid material at a sufficiently low oxygen potential to form one of the group consisting of rare earth sulphides and rare earth oxysulphides and mixtures thereof to reduce substantially the unreacted sulphur.

2. The method of desulphurizing fluid materials as claimed in claim 1 wherein Bastnasite concentrates are reacted with sulphur.

3. The method of desulphurizing fluid materials as claimed in claims 1 or 2 wherein the oxygen potential is maintained at a low level by reducing the partial pressure of CO.

4. The method of claim 3 wherein the partial pressure of CO is maintained below about 0.1 atmosphere.

5. The method of desulphurizing fluid materials as claimed in claim 1 wherein Bastnasite is added to the fluid material by injecting the rare earth oxide into the fluid material in a stream of inert gas sufficient to dilute carbon monoxide formed in the reaction of a level below about 0.1 atmosphere.

6. The method of desulphurizing fluid material as claimed in claim 5 wherein the inert gas is nitrogen.

7. The method of desulphurizing fluid material as claimed in claim 1 wherein Bastnasite is added to said fluid material subject to a vacuum sufficient to maintain the partial pressure of carbon monoxide below about 0.1 atmosphere.

* * * * *

UNITED STATES PATENT AND TRADEMARK OFFICE

CERTIFICATE OF CORRECTION

PATENT NO. : 4,224,058

DATED : September 23, 1980

INVENTOR(S) : WILLIAM G. WILSON and D. ALAN R. KAY

It is certified that error appears in the above-identified patent and that said Letters Patent are hereby corrected as shown below:

Column 2, line 14, equation (1) should be written -- $2CeO_{2(s)}+[C] = Ce_2O_{3(s)}+CO_{(g)}$ --.

Column 2, line 16, equation (2) should be written -- $RE_2O_{3(s)}+[C]+[S]_{1w/o} = RE_2O_2S_{(s)}+CO_{(g)}$ --.

Column 2, line 59 "reversed" should read --represented--.

Column 3, in Table 1, under "Reaction", the eighth equation should read -- $Ce_2O_2S_{(s)} = 2Ce_{(l)}+O_{2(g)}+1/2S_{2(g)}$ --.

Column 6, the last line, "1[16" should read -- ~16 --.

Signed and Sealed this

*Thirty-first* Day of *March 1981*

[SEAL]

*Attest:*

RENE D. TEGTMEYER

*Attesting Officer*

*Acting Commissioner of Patents and Trademarks*